US011617389B2

(12) United States Patent
Zhou et al.

(10) Patent No.: US 11,617,389 B2
(45) Date of Patent: Apr. 4, 2023

(54) TOBACCO/HERB GRINDING AND LOADING DEVICE AND METHOD THEREFOR

(71) Applicant: BBK TOBACCO & FOODS, LLP., Phoenix, AZ (US)

(72) Inventors: Kai Zhou, Tempe, AZ (US); Ian Kobe, Tempe, AZ (US)

(73) Assignee: BBK Tobacco & Foods, LLP, Phoenix, AZ (US)

( * ) Notice: Subject to any disclaimer, the term of this patent is extended or adjusted under 35 U.S.C. 154(b) by 355 days.

(21) Appl. No.: 15/931,420

(22) Filed: May 13, 2020

(65) Prior Publication Data

US 2021/0352955 A1 Nov. 18, 2021

(51) Int. Cl.

| | |
|---|---|
| ***A24F 23/04*** | (2006.01) |
| ***A24B 7/00*** | (2006.01) |
| *B26B 27/00* | (2006.01) |

(52) U.S. Cl.

CPC ..... *A24B 7/00* (2013.01); *A24F 23/04* (2013.01); *B26B 27/00* (2013.01)

(58) Field of Classification Search

CPC ..... A24F 23/04; A24B 7/00

See application file for complete search history.

(56) References Cited

U.S. PATENT DOCUMENTS

| | | | | |
|---|---|---|---|---|
| 4,167,238 | A * | 9/1979 | Koski | A24F 23/04 222/413 |
| 10,028,618 | B1 | 7/2018 | Benson | |
| 2015/0298135 | A1 | 10/2015 | Spielman | |
| 2016/0029691 | A1 | 2/2016 | Ruzycky | |
| 2018/0213838 | A1 | 8/2018 | Richmond et al. | |
| 2018/0338642 | A1 | 11/2018 | Staiano et al. | |
| 2018/0344086 | A1* | 12/2018 | McDonough Migale | A47J 42/24 |
| 2019/0269277 | A1 | 9/2019 | Larose | |

FOREIGN PATENT DOCUMENTS

| | | |
|---|---|---|
| WO | 2019092477 | 5/2019 |

OTHER PUBLICATIONS

The Otto: Smart, Automatic Grinder Source: https://waterbedsnstuff.com/the-otto-smart-automatic-grinder/.

* cited by examiner

*Primary Examiner* — Kelly M Gambetta
*Assistant Examiner* — Jennifer A Kessie
(74) *Attorney, Agent, or Firm* — Jeffrey D. Moy; Weiss & Moy, PC

(57) ABSTRACT

A device for grinding, loading and forming smoking articles has a grinding unit. A holding chamber is removably coupled to the grinding unit. A cone holding section is positioned within the holding chamber. A rotational device is coupled to the grinding unit and the cone holding section, wherein the rotational device rotates the grinding device and moves the cone holding section in an up and down manner within the holding chamber.

19 Claims, 4 Drawing Sheets

TOBACCO/HERB GRINDING AND LOADING DEVICE AND METHOD THEREFOR

TECHNICAL FIELD

The present application relates generally to the technical field of tobacco and herbal smoking articles, and more specifically, to the technical field of a device to grind and load a predetermined number of preformed conical paper wrappers with the grounded smokable tobacco and/or herbs.

BACKGROUND

Smoking articles such as cigarettes may be formed from paper tubes that are stuffed with finely cut tobacco leaves and/or herbs. Most cigarettes may be manufactured by large tobacco manufacturing companies. However, some people prefer to hand make their own cigarettes rather than purchasing them. Handmade smoking articles, such as cigarettes and the like, is a well-known practice.

In one process, handmade smoking articles may be made by grinding tobacco leaves and/or herbs. Rolling paper may be formed into a cone and used to scoop up small amounts of the grounded smokable tobacco and/or herbs. The maker of the smoking article may then hold the open end of the cone upward allowing small amounts of the scooped up grounded smokable tobacco and/or herbs to fall into the cone. This process continues until a desired amount of ground smokable tobacco and/or herbs is held within the cone. The maker may use a rod or similar object to compact the ground smokable tobacco and/or herbs into the cone. This process is repeated until the cone is filled and compacted with the desired amount of ground smokable tobacco and/or herbs. The open end of the cone is then sealed forming the smoking article. Alternatively, the ground tobacco and/or herbs may be placed on a paper which is then rolled into a tube. A filter may be included in the pre-rolled paper tube or added after to the pre-rolled paper tube.

Unfortunately, rolling individual smoking articles is time consuming. Further, rolling individual smoking articles may cause inconsistency in the smoking articles. This may be due to the smoking articles being unevenly filled and/or compacted with the ground smokable tobacco and/or herbs. Unevenly filling and/or compacting the ground smokable tobacco and/or herbs may adversely affect burn rates and temperatures of the smoking articles. That, in turn, can adversely affect the smoke flavors and result in the generation of unwanted combustion byproducts during the material burn.

Therefore, it would be desirable to provide a system and method that overcomes the above.

SUMMARY

In accordance with one embodiment, a device for grinding, loading and forming smoking articles is disclosed. The device has a grinding unit. A holding chamber is removably coupled to the grinding unit. A cone holding section is positioned within the holding chamber; and a rotational device is coupled to the grinding unit and the cone holding section. The rotational device rotates the grinding device and moves the cone holding section in an up and down manner within the holding chamber.

In accordance with one embodiment, a device for grinding, loading and forming smoking articles is disclosed. The device has a grinding unit. The grinding unit has an upper grinding unit and a lower grinding unit. The upper grinding unit is positioned over the lower grinding unit. A holding chamber is removably coupled to the grinding unit, the lower grinding unit removably positioned within the holding chamber. A cone holding section is positioned within the holding chamber. A tension device is positioned in a bottom section of the holding chamber and applies a force against a bottom of the cone holding section. A rotational device is coupled to the grinding unit and the cone holding section, wherein the rotational device rotates the grinding device and moves the cone holding section in an up and down manner within the holding chamber.

In accordance with one embodiment, a device for grinding, loading and forming smoking articles is disclosed. The device has a grinding unit. The grinding unit has an upper grinding unit. The upper grinding unit has an upper cap. A grinding plate is coupled to a bottom section of the cap. A plurality of upper grinding unit teeth is attached to a first surface of the grinding plate. The grinding unit has a lower grinding unit. The lower grinding unit has a lower cap having an open end. A plurality of openings is formed in a bottom surface of the lower cap. A plurality of lower grinding unit teeth is formed on the bottom surface of the lower cap. The upper grinding unit is positioned over the lower grinding unit. A holding chamber is removably coupled to the grinding unit. The holding chamber has a lower section removably attached to the holding chamber. A ridge is formed around an upper inner perimeter of the holding chamber holding the lower grinding unit within the holding chamber. A cone holding section is positioned within the holding chamber. The cone holding section has a body section. A plurality of channels is formed in the body section, each channel extending through the body section and each configured to hold a smoking article. A rotational channel is formed in a center area of the body section. A tension device is positioned in a bottom section of the holding chamber and applies a force against a bottom of the cone holding section. A rotational device is coupled to the grinding unit and the rotational channel of the cone holding section, wherein the rotational device rotates the grinding device and moves the cone holding section in an up and down manner within the holding chamber.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure relates to a device to grind tobacco leaf/herb and load the grinded tobacco leaf/herb into a plurality of preformed conical paper wrappers forming a plurality of smoking articles. The device may allow a user to select the number of smoking articles to form. Once the preformed conical paper wrappers are filled with a desired grounded tobacco leaf/herb, the device may be disassembled to remove the preformed conical paper wrappers out of the device.

Figure 1:
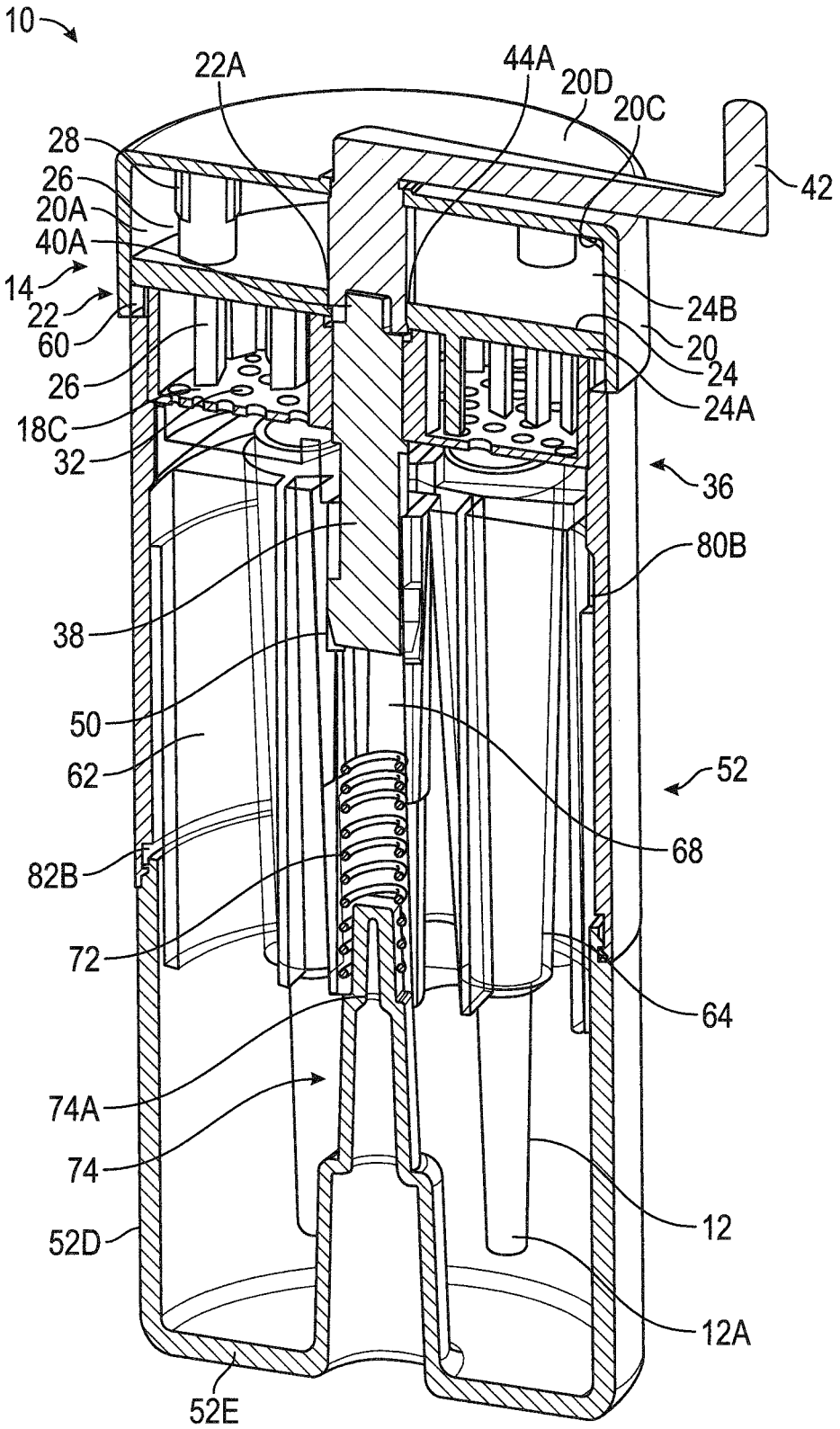
FIG. 1 is a cross-sectional view of an exemplary tobacco leaf/herb grinding, cone loading and forming device in accordance with one aspect of the present application.
Figure 2:
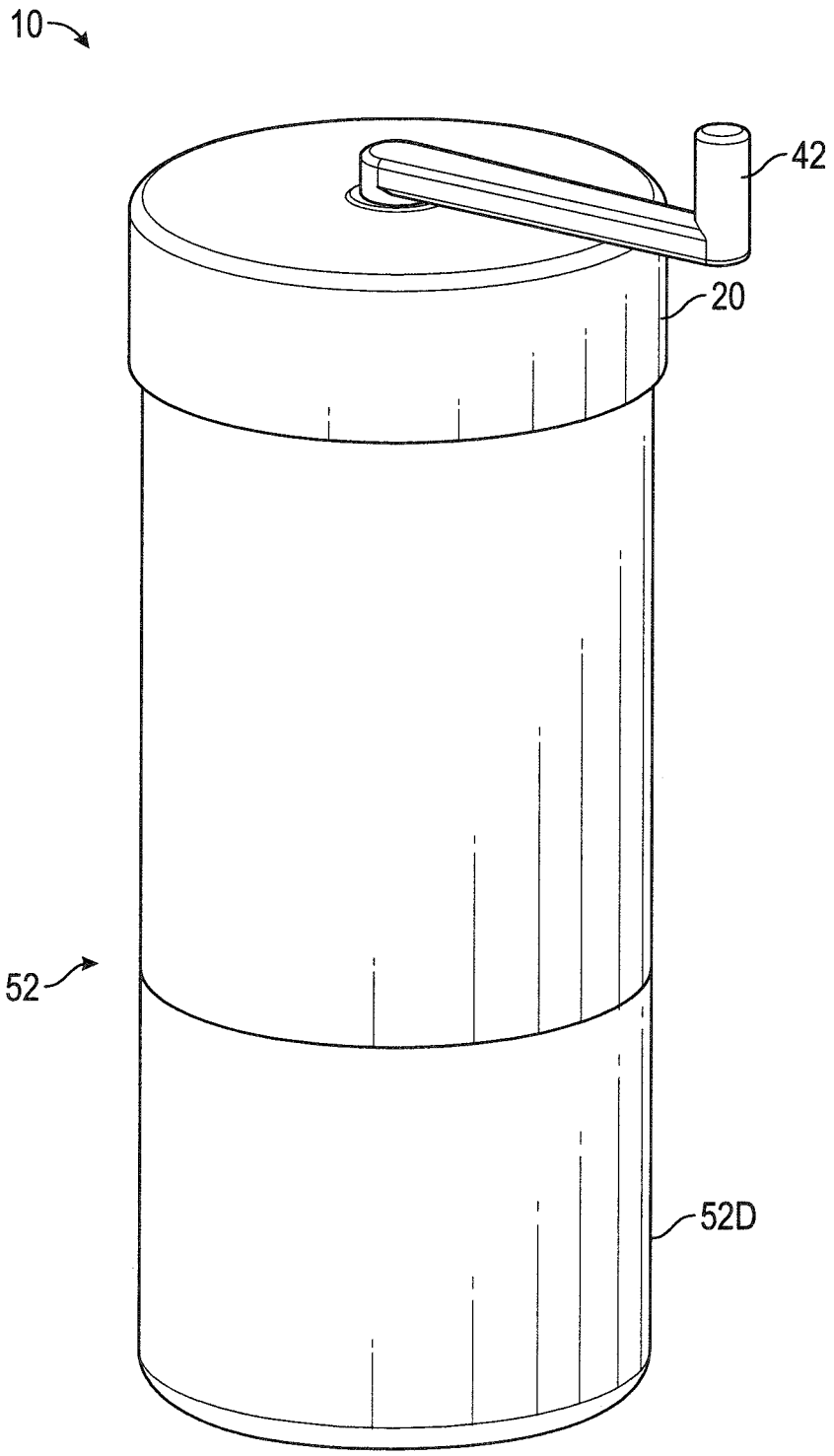
FIG. 2 is an elevated perspective view of the exemplary tobacco leaf/herb grinding, cone loading and forming device in accordance with one aspect of the present application.
Figure 3:
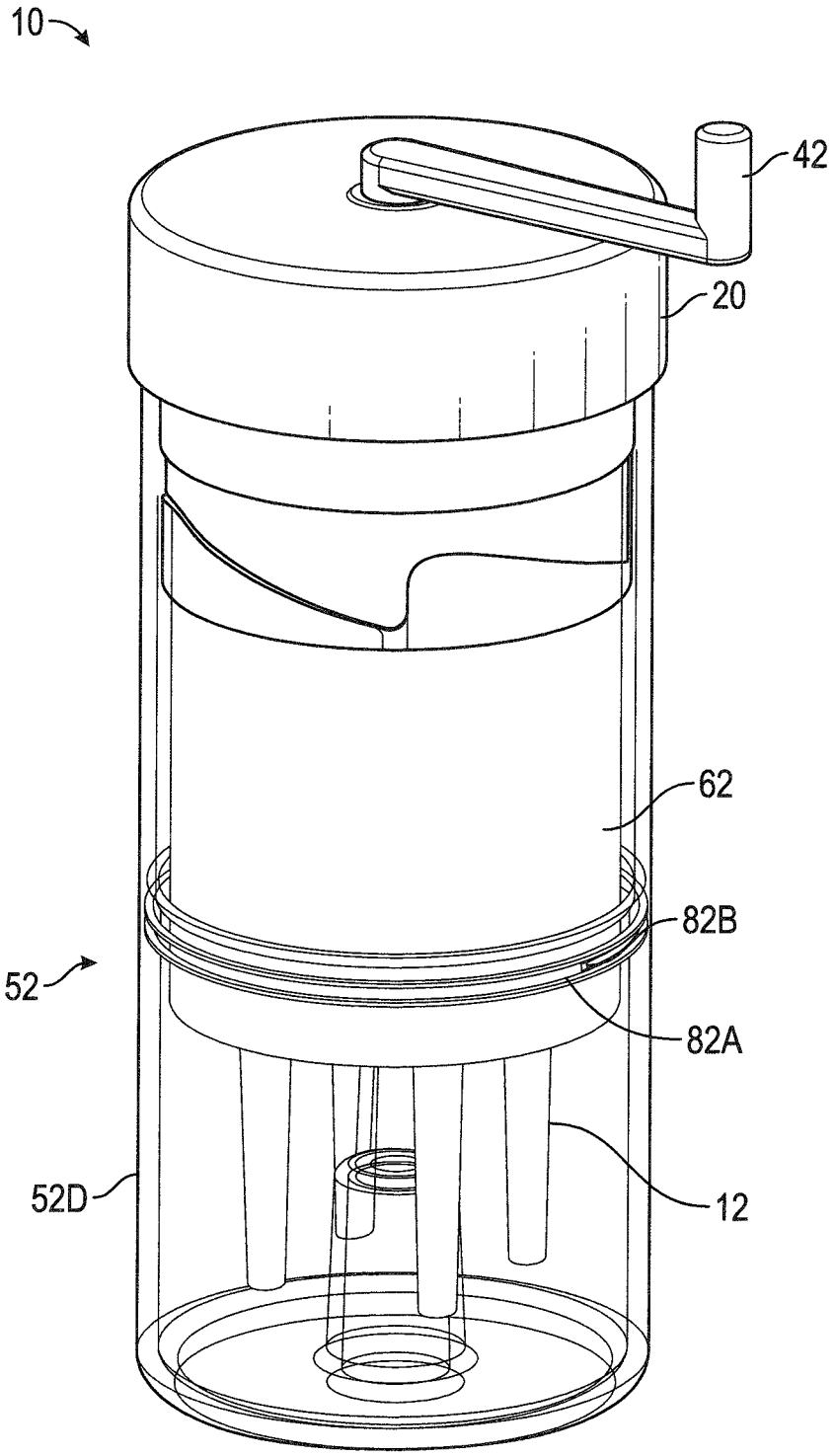
FIG. 3 is an elevated perspective cutaway view of the exemplary tobacco leaf/herb grinding, cone loading and forming device showing an interior of the device in accordance with one aspect of the present application.
Figure 4:
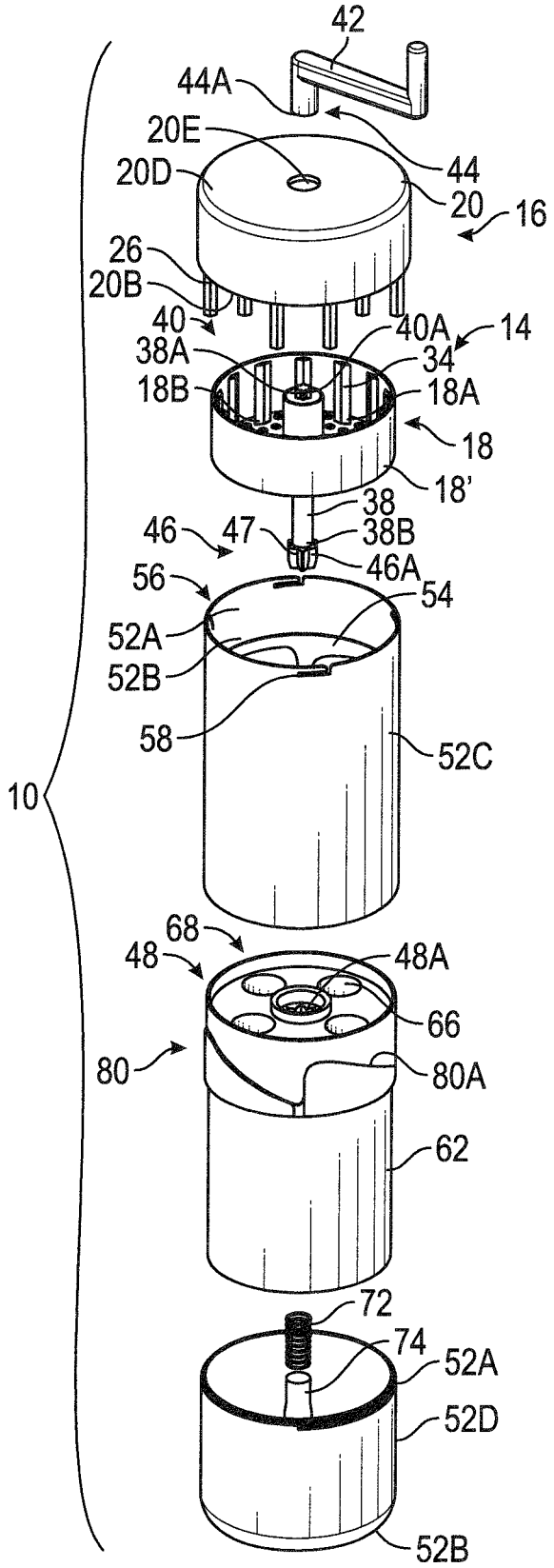
FIG. 4 is an exploded perspective view of the exemplary tobacco leaf/herb grinding, cone loading and forming device in accordance with one aspect of the present application.

Referring to FIGS. 1-4 a device 10 may be seen for grinding tobacco leaf/herb and loading the grounded tobacco leaf/herb intone or more preformed conical paper wrappers 12. The device 10 may be formed of a grinding unit 14 and a holding chamber 52 removably attached and located below the grinding unit 14. The holding chamber 52 may be used to secure and hold one or more preformed conical paper wrappers 12 in an upright position and to receive the grounded tobacco leaf/herb from the grinding unit 14.

The grinding unit 14 may be formed of an upper grinding unit 16 and a lower grinding unit 18. The upper grinding unit 16 may be formed of a cap 20. In the present embodiment, the cap 20 may be cylindrical in shape with a hollow interior 20A and an open end 20B. An upper grinding plate 22 may be positioned and held within the hollow interior 20A of the cap 20. The upper grinding plate 22 may be formed of a circular plate 24. The circular plate 24 may be of a size smaller than that of the open end 20B of the cap 20. This may allow the circular plate 24 to fit within the open end 20B of the cap 20.

A plurality of teeth 26 may be formed on a first surface 24A of the circular plate 24. The teeth 26 may extend up from the first surface 24A. The grinding plate 24 may have one or more alignment pins 26 formed on a second surface 24B of the circular plate 24 wherein the second surface 24B is a surface on an opposing side of the circular plate 24. The alignment pins 26 may be used to position and hold the upper grinding plate 22 within the hollow interior 20A of the cap 20. The alignment pins 26 may be positioned within corresponding alignment receptacles 28 formed on an interior bottom surface 20C of the cap 20. In accordance with one embodiment, the alignment pins 26 and corresponding alignment receptacles 28 may hold the upper grinding plate 22 within the hollow interior 20A of the cap 20 below the open end 20B so that an inner diameter ring 30 may be visible between the open end 20B of the cap 20 and the upper grinding plate 22. Connectors may be used to secure the alignment pins 26 within corresponding alignment receptacles 28. In accordance with one embodiment, the connectors may be screws or similar devices.

The grinding unit 14 may have a lower grinding unit 18. The lower grinding unit 18 may be formed of a cap 18'. The cap 18' may be cylindrical in shape with a hollow interior 18A and an open end 18B. The lower grinding unit 18 may be smaller in diameter than the upper grinding unit 16. This may allow the open end 20B of the cap 20 forming a part of the upper grinding unit 16 to be positioned over and slid on top of the open end 18B of the lower grinding unit 18.

The lower grinding unit 18 may have an interior bottom surface 18C. The interior bottom surface 18C may have a plurality of openings 32 formed through the interior bottom surface 18C. Thus, the interior bottom surface 18C may be a perforated bottom surface. A plurality of teeth 34 may be formed on the interior bottom surface 18C of the lower grinding unit 18. The teeth 34 may extend up from the interior bottom surface 18C.

When the upper grinding unit 16 is slid on top and over the open end 18B of the lower grinding unit 18, the teeth 26 of the upper grinding unit 16 may extend downward and touch the interior bottom surface 18C of the lower grinding unit 18. The teeth 34 of the lower grinding unit 18 may extend upwards and towards the first surface 24A of the grinding plate 24. The teeth 26 and 34 may be positioned such that when the grinding unit 14 is rotated, the teeth 26 and 34 work in concert with each other (e.g., move past each other) so that the tobacco leaf/herb placed within the grinding unit 14 may be forced or pushed between the teeth 26 and 34 thereby breaking-up, macerating, and/or grinding the tobacco leaf/herb into smaller, generally fine bits or portions which are more easily burned for smoking. The movement of the teeth 26 and 34 may push the smaller finer ground tobacco leaf/herb through the plurality of openings 14 formed through the interior bottom surface of the lower grinding unit 18.

The grinding unit 14 may have a rotating mechanism 36. The rotating mechanism 36 may allow the teeth 26 and 34 to move past each other, thereby breaking-up, macerating, and/or grinding the tobacco leaf/herb. The rotating mechanism 36 may rotate the upper grinding unit 16 relative to the lower grinding unit 18 or alternatively, rotate the lower grinding unit 18 relative to the upper grinding unit 16. The rotating mechanism 36 may be formed of an axle 38. In the present embodiment, the axle 38 may be attached to and extend through the interior bottom surface 18C of the lower grinding unit 18. As many be seen in FIGS. 1 and 4, a first end 38A of the axle 38 may extend above the interior bottom surface 18C and a second end 38B of the axle 38 may extend below the interior bottom surface 18C.

A connector 40 may be formed on a first end 38A of the axle 38. The connector 40 may be used to secure a handle 42 to the axle 38. The connector 40 may engage a connector 44 formed on the handle 42. In accordance with one embodiment, the connector 40 may be a male connector 40A. The male connector 40A may engage a female connector 44A formed on the handle 42. In the present embodiment, the handle 42 may be positioned on a top surface 20D of the cap 20. The handle 42 may extend down through an opening 20E formed through the cap 20 and through an opening 22A formed through the upper grinding plate 22.

A connector 46 may be formed on a second end 38B of the axle 38. The connector 46 may engage a rotational device 48. In the present embodiment, the connector 46 may be a male gear adapter 46A having a plurality of teeth 47, while the rotational device 48 may be a female gear adapter 48A having a plurality of teeth cutouts 50. When the connector 46 engages the rotational device 48, the teeth 47 of the male gear adapter 46A engage the teeth cutouts 50 of the female gear adapter 48A allowing rotation of the grinding unit 14.

In accordance with one embodiment, when the upper grinding unit 16 is placed over the open end 18B of the lower grinding unit 18, the connector 40 on the first end 38A of the axle 38 may engage the connector 44 formed on the handle 42. The second end 38B of the axle 38 may be inserted into the rotational device 48 such that the connector 46 formed on the second end 38B of the axle 38 engages the rotational device 48. In the present embodiment, the rotation of the handle 42 may rotate the lower grinding unit 18 relative to the upper grinding unit 16. The rotation may allow the teeth 26 and 34 to move past each other, thereby breaking-up, macerating, and/or grinding the tobacco leaf/herb.

The grinding unit 14 may be removably coupled to the holding chamber 52. The holding chamber 52 may be used to secure and hold one or more preformed conical paper wrappers 12 in an upright position and to distribute receive the grounded tobacco leaf/herb from the grinding unit 14 to the one or more preformed conical paper wrappers 12.

The holding chamber 52 may take on different geometric configurations. In accordance with the present embodiment, the holding chamber 52 may be cylindrical in shape similar to the grinding unit 14. However, this is shown as an example and should not be seen in a limiting manner. The holding chamber 52 may have an open top 52A and a closed bottom 52B.

The holding chamber 52 may be sized to allow the lower grinding unit 18 to be placed within the open top 52A and held within an interior of the holding chamber 52. In accordance with one embodiment, a ledge 54 may be formed in a top interior area 52B of the holding chamber 52. The ledge 54 may be formed around an interior perimeter of the top interior area 52B of the holding chamber 52. The ledge 54 may be used to allow the lower grinding unit 18 to be inserted within the open top 52A and held within top interior area 52B of the holding chamber 52.

In accordance with one embodiment, the upper grinding unit 16 may be sized to be placed over the open top 52A of the holding chamber 52 and hence over the lower grinding unit 18 when the lower grinding unit 18 is within top interior area 52B of the holding chamber 52. A locking mechanism 56 may be used to secure the upper grinding unit 16 to the holding chamber 52. In accordance with one embodiment, the locking mechanism 56 may be formed of a plurality of channels 58 formed around an upper exterior perimeter of the holding chamber 52. A corresponding number of tabs 60 may be formed around an interior perimeter of the cap 20 of the upper grinding unit 16. When the upper grinding unit 16 is placed over the open top 52A of the holding chamber 52, rotation of the upper grinding unit 16 may cause the tabs 60 to rotate into a corresponding channel 58 thereby securing the upper grinding unit 16 to the holding chamber 52.

Located below the ledge 54 may be a cone holding member 62. The cone holding section 62 may be removably positioned in a middle section 52C of the holding chamber 52. In accordance with one embodiment, the cone holding section 62 may be formed of a body section 62A. The body section 62A may be cylindrical in shape. The cone holding section 62 may have a smaller diameter than the cone holding member 62 to allow the cone holding section 62 to be inserted and held within the cone holding member 62. The body section 62A may have a plurality of channels 64 formed therethrough. In the present embodiment, the channels 64 may be conical in shape. Each channel 64 may be configured to hold one preformed conical paper wrapper 12 therein with a closed bottom section 12A of the preformed conical paper wrapper 12 extending out of the channel 64 into a bottom area 52D of the holding chamber 52.

One or more covers 66 may be provided. Each cover 66 may be used to close a corresponding channel 64. The covers 66 may allow one to determine how many preformed conical paper wrappers 12 may be filled with the grinding the tobacco leaf/herb.

Located in a center area of the body section 62A of the cone holding section 62 may be a rotational channel 68. The female gear assembly 48A may be formed within the rotational channel 68. Rotation of the handle 42 may cause the axle 38 to rotate. Rotation of the axle 38 may cause the teeth 48 of the male gear adapter 46A to engage the teeth cutouts 50 of the female gear assembly 48A. This may allow the grinding unit 14 to rotate. In the present embodiment, the rotation of the handle 42 may rotate the lower grinding unit 18 relative to the upper grinding unit 16.

The rotation of the axle 38 may also allow the movement of the cone holding section 62 in an up and down manner. The movement of the cone holding section 62 in an up and down manner may allow the grounded tobacco leaf/herb to be compacted in the preformed conical paper wrappers 12. The rotation of the axle 38 may move a ratchet mechanism 80. Rotation of the axle 38 may cause the ratchet mechanism 80 to move the cone holding section 62 in an up and down manner. In accordance with one embodiment, the ratchet mechanism 80 may be formed an up/down pattern 80A formed on an exterior surface 62A of the cone holding section 62. A corresponding up/down pattern 80B may be formed on an interior surface of the middle section 52C of the holding chamber 52C. Rotation of the axle 38 may cause the cone holding section 62 to move along the up/down pattern 80A forcing the cone holding section 62 to move in an up/down manner.

As the cone holding section 62 moves downward, the cone holding section 62 may engage a tension device 70. Further rotation of the axle 38 may cause the tension device 70 to force the cone holding section 62 in an upwards direction. The continued rotation of the axle 38 may continue the up and down movement of the cone holding section 62 thereby compacting the grounded tobacco leaf/herb in the preformed conical paper wrappers 12.

The tension device 70 may be formed in the bottom area 52D of the holding chamber 52. As may be seen in FIG. 1, the tension device 70 may be positioned in a middle of the bottom area 52D of the holding chamber 52. In accordance with one embodiment, the tension device 70 may be formed of a spring 72 and a spring holder 74. The spring holder 74 may be formed on a bottom surface 52E of the bottom area 52D of the holding chamber 52. The spring holder 74 may be formed of a peg member 74A which may extend up from the bottom surface 52E of the bottom area 52D of the holding chamber 52. The peg member 74A may be tiered such that when a bottom section 72B of the spring 72 is positioned on the peg member 74A, only a predetermined portion of the bottom section 72B spring 72 may extend down on the peg member 74A. A top section 72A of the spring may be pressed against a bottom of the cone holding section 62.

The holding chamber 52 may be formed of one or more detachable sections. In accordance with one embodiment, the bottom area 52D of the holding chamber 52 may be removably detached from a remainder of the holding chamber 52. By removing the bottom area 52D, one may remove the cone holding section 62 from the holding chamber 52. This may allow one to remove the preformed conical paper wrappers 12 that have been filled with the grounded tobacco leave/herbs. In accordance with one embodiment, threading 82A and 82B may be used to removably couple the bottom area 52D of the holding chamber 52 from the remainder of the holding chamber 52. It should also be noted that when the upper grinding unit 16 is removed from the holding chamber 52, the lower grinding unit 18 may also be removed thereby allowing one to load the cone holding section 62 with one or more preformed conical paper wrappers 12.

The foregoing description is illustrative of particular embodiments of the application, but is not meant to be a limitation upon the practice thereof. The following claims, including all equivalents thereof, are intended to define the scope of the application.

What is claimed is:

1. A device for grinding, loading and forming smoking articles comprising:

a grinding unit;

a holding chamber removably coupled to the grinding unit;

a cone holding section positioned within the holding chamber, wherein the cone holding section comprises:

a body section;

a ratchet mechanism formed on the body moving the cone holding section in an up and down manner;

a plurality of channels formed in the body section, each channel extending through the body section, and each configured to hold a conical paper wrapper;

a plurality of covers, wherein each cover closes a corresponding channel allowing a user to select a number of conical paper wrappers to be filled forming the smoking articles;

a rotational channel formed in a center area of the body section and engaging the rotational device; and a rotational device having a gearing mechanism coupled to the grinding unit and the cone holding section, wherein the rotational device rotates the grinding device and moves the cone holding section in the up and down manner via the ratchet mechanism within the holding chamber.

2. The device of claim 1, comprising a tension device positioned in a bottom section of the holding chamber and applying a force against a bottom of the cone holding section, the tension device forcing the cone holding section upwards after the ratch mechanism moves the cone holding section downwards.

3. The device of claim 1, wherein the grinding unit comprises:

an upper grinding unit; and a lower grinding unit, the lower grinding unit removably positioned within the holding chamber;

wherein the upper grinding unit is positioned over the lower grinding unit.

4. The device of claim 3, wherein the upper grinding unit comprises:

an upper cap;

a grinding plate coupled to a bottom section of the cap;

a plurality of upper grinding unit teeth attached to a first surface of the grinding plate.

5. The device of claim 4, comprising an alignment device positioning the grinding plate to the bottom section of the cap.

6. The device of claim 3, wherein the lower grinding unit comprises:

a lower cap having an open end;

a plurality of openings formed in a bottom surface of the lower cap; and a plurality of lower grinding unit teeth formed on the bottom surface of the lower cap.

7. The device of claim 1, wherein the holding chamber comprises a ridge formed around an upper inner perimeter of the holding chamber holding a lower grinding unit of the grinding unit within the holding chamber.

8. The device of claim 1, wherein the holding chamber comprises a lower section removably attached to the holding chamber.

9. The device of claim 1, wherein the rotational device comprises:

an axle coupled to the grinding unit;

a handle attached to one end of the axle; and a first gear mechanism formed in the cone holding section;

a second gear mechanism formed on a second end of the axle;

wherein rotation of the handle rotates the grinding unit and moves the cone holding section up and down.

10. A device for grinding, loading and forming smoking articles comprising:

a grinding unit, wherein the grinding unit comprises:

an upper grinding unit; and a lower grinding unit;

wherein the upper grinding unit is positioned over the lower grinding unit;

a holding chamber removably coupled to the grinding unit, the lower grinding unit removably positioned within the holding chamber;

a cone holding section positioned within the holding chamber and having a plurality of channels formed therein, each of the plurality of channels used to hold a conical paper wrapper;

a ratchet mechanism formed on the cone holding section;

a plurality of covers, wherein each cover closes a corresponding channel allowing a user to select a number of conical paper wrappers to be filled forming the smoking articles;

a tension device positioned in a bottom section of the holding chamber and applying a force against a bottom of the cone holding section; and a rotational device having a gearing mechanism coupled to the grinding unit and the cone holding section, wherein the rotational device rotates the grinding device and moves the cone holding section via the ratchet mechanism in an up and down manner within the holding chamber, wherein the tension device forcing the cone holding section upwards after the ratch mechanism moves the cone holding section downwards.

11. The device of claim 10, wherein the upper grinding unit comprises:

an upper cap;

a grinding plate coupled to a bottom section of the cap;

a plurality of upper grinding unit teeth attached to a first surface of the grinding plate.

12. The device of claim 11, comprising an alignment device positioning the grinding plate to the bottom section of the cap.

13. The device of claim 10, wherein the lower grinding unit comprises:

a lower cap having an open end;

a plurality of openings formed in a bottom surface of the lower cap; and a plurality of lower grinding unit teeth formed on the bottom surface of the lower cap.

14. The device of claim 10, wherein the holding chamber comprises a ridge formed around an upper inner perimeter of the holding chamber holding the lower grinding unit within the holding chamber.

15. The device of claim 10, wherein the holding chamber comprises a lower section removably attached to the holding chamber.

16. The device of claim 10, wherein the cone holding section comprises:

a body section;

a plurality of channels formed in the body section, each channel extending through the body section and each configured to hold one of the conical paper wrappers used to form a smoking article; and a rotational channel formed in a center area of the body section and engaging the rotational device.

17. The device of claim 10, wherein the rotational device comprises:

an axle coupled to the grinding unit;

a handle attached to one end of the axle; and a first gear mechanism formed in the cone holding section;

a second gear mechanism formed on a second end of the axle;

wherein rotation of the handle rotates the grinding unit and moves the cone holding section up and down.

18. A device for grinding, loading and forming smoking articles comprising:

a grinding unit, wherein the grinding unit comprises:

an upper grinding unit, wherein the upper grinding unit comprises:

an upper cap;

a grinding plate coupled to a bottom section of the cap;

a plurality of upper grinding unit teeth attached to a first surface of the grinding plate; and a lower grinding unit, wherein the lower grinding unit comprises:

a lower cap having an open end;

a plurality of openings formed in a bottom surface of the lower cap; and a plurality of lower grinding unit teeth formed on the bottom surface of the lower cap;

wherein the upper grinding unit is positioned over the lower grinding unit;

a holding chamber removably coupled to the grinding unit, wherein the holding chamber comprises a lower section removably attached to the holding chamber;

a ridge formed around an upper inner perimeter of the holding chamber holding the lower grinding unit within the holding chamber;

a cone holding section positioned within the holding chamber, wherein the cone holding section comprises:

a body section;

a plurality of channels formed in the body section, each channel extending through the body section and each configured to hold a single conical paper wrapper to be filled to form a smoking article;

a plurality of covers, wherein each cover closes a corresponding channel allowing a user to selected which of the plurality of channels are to be filled;

a ratchet mechanism formed on an exterior surface of the body; and a rotational channel formed in a center area of the body section;

a tension device positioned in a bottom section of the holding chamber and applying a force against a bottom of the cone holding section; and a rotational device having a gearing mechanism coupled to the grinding unit and the rotational channel formed in the cone holding section, wherein the rotational device rotates the grinding device and moves the cone holding section in an up and down manner via the ratchet mechanism within the holding chamber.

19. The device of claim 18, wherein the rotational device comprises:

an axle coupled to the bottom surface of the lower cap;

a handle attached to one end of the axle; and a first gear mechanism formed in the rotational channel;

a second gear mechanism formed on a second end of the axle;

wherein rotation of the handle rotates the grinding unit and moves the cone holding section up and down.

* * * * *